United States Patent [19]

Grover

[11] Patent Number: 4,619,469

[45] Date of Patent: Oct. 28, 1986

[54] CARD FOR MICROFILM AND METHOD OF FORMING SAME

[76] Inventor: Jerry D. Grover, 5406 Oliver, Kansas City, Kans. 66106

[21] Appl. No.: 401,636

[22] Filed: Jul. 26, 1982

[51] Int. Cl.[4] ..... B42D 15/00; G09F 3/03

[52] U.S. Cl. ..... 283/76; 283/100; 283/101; 283/103; 283/105; 283/900; 283/901; 156/291

[58] Field of Search ..... 283/67, 70, 72, 74, 283/75, 76, 100, 101, 103, 105, 107, 109, 111, 900, 901; 40/158 B; 156/291

[56] References Cited

U.S. PATENT DOCUMENTS

| | | | |
|---|---|---|---|
| 3,117,608 | 1/1964 | Goss et al. | 283/76 X |
| 3,792,542 | 2/1974 | Cohan | 40/158 B |
| 3,810,566 | 5/1974 | Adams et al. | 40/158 R |
| 3,873,405 | 3/1975 | Wilkes | 156/108 X |
| 3,921,318 | 11/1975 | Calavetta | 40/2.2 |
| 4,031,640 | 6/1977 | Hanna, Jr. et al. | 40/2.2 |
| 4,252,427 | 2/1981 | Brecht et al. | 354/109 |
| 4,259,391 | 3/1981 | Brecht | 428/195 |
| 4,318,554 | 3/1982 | Anderson et al. | 283/7 |

FOREIGN PATENT DOCUMENTS 2262589 7/1974 Fed. Rep. of Germany .... 40/158 B

*Primary Examiner*—Robert L. Spruill
*Assistant Examiner*—Taylor J. Ross
*Attorney, Agent, or Firm*—Litman, Day and McMahon

[57] ABSTRACT

A card for microfilm and the like including a core with a cut-out open at an edge thereof and front and back surfaces. Front and back transparent panels are bonded to the front and back core surfaces respectively in covering relation to the cut-out. An opaque security cover is removably secured to one of the front and back panels in covering relation over the cut-out. A pocket is formed by the cut-out between the front and back panels and is adapted to receive a microfilm segment readable through the front panel with the cover removed from the card. A method of forming the card includes the steps of heat laminating the front and back panels against the core front and back surfaces respectively with a microfilm segment and a spacer positioned in the pocket and removably securing the opaque cover to one of the front and back panels in covering relation over the cut-out.

21 Claims, 5 Drawing Figures

NAME :
PHONE :
ADDRESS:
SPECIAL INSTRUCTIONS:
PERSONAL PHYS:
PHYSICIANS PHONE:
THIS SEAL TO BE BROKEN ON AUTHORITY OF LICENSED PHYSICIAN ONLY. BREAK SEAL, INSERT CARD INTO A STANDARD MICRO-FICHE READER TO DISPLAY EMERGENCY MEDICAL INFORMATION.
PHYSICIAN SIGNATURE

CARD FOR MICROFILM AND METHOD OF FORMING SAME

BACKGROUND OF THE INVENTION

1. Field of the Invention

The present invention relates to information bearing cards, and in particular, to a laminated card for carrying microfilm electrocardiograms.

2. Description of the Prior Art

Information bearing cards are well known and have been utilized for a variety of purposes. For example, in identification cards, photographs and other identifying material may be laminated between transparent plastic panels. Also, emergency medical information may be included in the card along with identifying material. Such cards are typically of a configuration and size, for example, rectangular and 2⅛ inches (53.975 millimeters) by 3⅜ inches (85.725 millimeters), such that they can conveniently be carried on a person in a wallet, credit card holder, purse and the like. Thus they are readily available, and in the case of cards bearing emergency medical information, may be accessed even though the person is unconcious, comotose or otherwise incapacitated.

Due to the size limitations of such cards, significant amounts of data can best be included therein by reproduction on microfilm. Although special viewing equipment such as microfilm readers and the like is required to access the information contained on such microfilm chips, such equipment is generally available at health care facilities to which a patient is likely to be transported in the event of a medical emergency. For example, the Anderson et al U.S. Pat. No. 4,318,554 shows a card with a microfilm chip or photograph bearing a medical history laminated between laminer parts in a window of a core. However, a drawback to this card arrangement is that the information on the microfilm chip is accessible by anyone having microfilm reading equipment. Furthermore, once the card is fully laminated, no provision is made for updating the microfilm medical records secured therein.

It has heretofore been proposed to include a variety of types of medical data in cards to be carried on a person. For example, allergies, current medication, blood types, unusual medical conditions, and medical histories may all be of use to attending medical personnel. For cardiovascular patients, information including medical histories, present medications and comments by the person's regular physician can be of extreme importance in the event of a heart attack or other cardiovascular problem. Oftentimes, the patient is rushed to the nearest available physician who may be encountering him or her for the first time. Valuable time can be lost in trying to obtain medical records from the person's regular physician, but without background information, the attending physician is at a serious handicap in rendering effective treatment without exposing the patient to undue risks. Thus, it is desirable for persons to carry with them information relating to their cardiovascular systems and particularly any data relating to previous cardiovascular problems and current medication.

Important medical data concerning heart patients is often contained in their cardiograms. By studying prior cardiograms, a heart specialist can determine variances from the patient's normal heartbeat and thus diagnose and treat a present heart problem. In the case of a patient having a history of cardiovascular problems, it is desirable to assemble a sequence of cardiograms taken at different times to show a history of the patient's cardiovascular condition. Cardiograms are even advisable for persons without a history of heart trouble. In the event a problem should develop later, a physician will be able to use the person's previous, healthy cardiogram as a reference indicating the patient's "normal" heartbeat and compare it to the patient's "abnormal" heartbeat. Such a cardiogram comparison can significantly aid a physician in prompt diagnosis and treatment.

Although medical records including cardiograms and the like may be of great importance in the event of a medical emergency, they may be considered confidential by both the patient and his or her regular physician. Therefore, it is desirable that the objective of providing convenient access to such information be balanced against the need to maintain a degree of confidentiality.

As an indication of the number of persons who could potentially benefit from using the present invention, it is estimated by the American heart association that 41,290,000 persons in the United States presently have some form of cardiovascular disease. Furthermore, one and one-half million Americans annually may have a heart attack. Finally, in the year 1979, 975,500 persons in this country died of heart and blood vessel disease. In treating heart attack victims, prompt diagnosis and treatment is often of the utmost importance. The availability of medical records including cardiograms and the like may thus have a significant effect on a person's chances for recovery.

SUMMARY OF THE INVENTION

In the practice of the present invention, a card for microfilm and the like is provided which includes a core having opposite side edges, top and bottom edges, a cut-out open at one of the side edges and front and back surfaces. Front and back transparent panels are thermally laminated to the core in covering relation over the cut-out.

An opaque cover is adhesively attached to the back panel and includes first and second portions demarcated by a tear line. The cover first portion is positioned in covering relation over the cut-out and is detachable from the cover second portion along the tear line and from the back panel. A pocket is formed in the cut-out between the front and back panels and is adapted to receive a plurality of microfilm segments in discrete compartments. The microfilm segments are readable through the front panel when the cover first portion is removed from the card.

A method of forming the card of the present invention includes the steps of assembling the core and panels with one or more microfilm segments positioned in the pocket. A spacer is inserted in the pocket in the areas not occupied by microfilm segments. The front and back panels are thermally laminated to the core and to each other between and adjacent the microfilm segments which are thereby sealed in respective, discrete compartments. Additional microfilm segments are subsequently added by placing them in unsealed portions of the pocket and laminating them in place with the spacer separating the panels at other unused portions of the pocket.

OBJECTS OF THE INVENTION

The principal objects of the present invention are: to provide a card adapted to receive microfilm and the like, to provide such a card which includes a pocket adapted to receive a plurality of microfilm segments; to provide such a card wherein the pocket is subdivided into a plurality of discrete compartments each adapted to receive a respective microfilm segment; to provide such a card with a cover whereby the microfilm segments are not readable with the cover in place; to provide such a card which is of a convenient size for carrying on a person; to provide such a card which may be formed using conventional thermal laminating techniques; to provide such a card which may be formed with transparent plastic panels; to provide such a card which is adapted to carry significant amounts of medical information on microfilm; to provide such a card which is adapted to carry microfilm cardiograms; to provide a method of forming a card wherein front and back transparent plastic panels are laminated to a core; to provide such a method wherein microfilm chips are inserted in a pocket of the card; to provide such a method wherein the pocket may be subdivided into discrete compartments each adapted to receive a respective microfilm segment; to provide such a method wherein portions of the pocket may be maintained open by the use of a spacer when the card is formed and when other portions of the pocket are formed into discrete compartments; to provide such a method wherein additional microfilm segments may be enclosed in discrete compartments from time to time; and to provide such a card which is economical to manufacture, efficient in use, capable of a long operating life and particularly well adapted for the proposed use thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
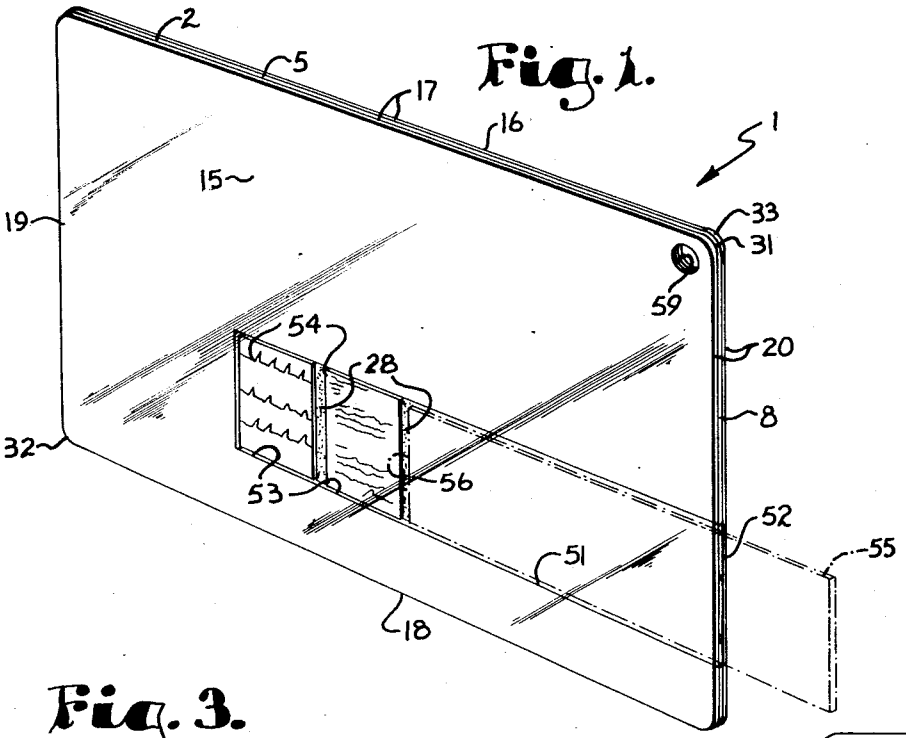
FIG. 1 is a perspective view of a card embodying the present invention.

For purposes of description herein, the terms "top", "bottom", "front", "back" and derivatives thereof shall relate to the invention as oriented in FIG. 1. However, it is to be understood that the invention may assume various alternative orientations, except where expressly specified to the contrary.

Referring to the drawings in more detail, the reference numeral 1 generally indicates a card having a core 2 with front and back surfaces 3 and 4 respectively, top and bottom edges 5 and 6 respectively and opposite side edges 7 and 8. A cut-out 9 having an elongated, rectangular configuration opens onto the side edge 7 and extends substantially parallel to the core top and bottom edges 5 and 6 in close spaced relation to the core bottom edge 6. The cut-out terminates in a blind end 10 in spaced relation from the core side edge 7.

The core 2 preferably comprises an opaque, thermoplastic polymer such as polyurethane. However, it will be appreciated that other materials for the core 2 may be used in place of polyurethane, including other plastics and paper card stock.

Front and back panels 15 and 16 respectively each have top and bottom edges 17 and 18 and opposite side edges 19 and 20. The front and back panels 15 and 16 are formed of a transparent, thermoplastic polymeric film, for instance an acrylic film. Although for simplicity of manufacture the same transparent material is used for both the front and back panels 15 and 16, the back panel 16 may be merely translucent rather than transparent.

The front and back panels 15 and 16 are each coated on one surface with heat sensitive adhesive 25, except that on each panel 15 and 16 an area 26 corresponding to the size and configuration of the core cut-out 9 is subdivided into a plurality of area subparts 27 by a plurality of lines 28 of adhesive 25 extending transversely across the area 26. The subparts 27 are free of the heat sensitive adhesive 25.

The core 2 and the panels 15 and 16 have substantially identical primarily rectangular configurations with rounded corners 31, 32 and 33 respectively. The respective core and panel top edges 5 and 17, bottom edges 6 and 18, and side edges 7, 8, 19 and 20 are substantially flush and extend colinearly in the finished card 1. The core 2 and the panels 15 and 16 are preferably of dimensions (i.e. wallet size) for convenient carrying on a person. For example, exemplary dimensions of the core 2 and panels 15 and 16 are approximately $2\frac{1}{8}$ inches (53.975 millimeters) between their respective top edges 5 and 17 and respective bottom edges 6 and 18; and $3\frac{3}{8}$ inches (85.725 millimeters) between the core side edges 7 and 8 and the panel side edges 19 and 20.

A primarily rectangular, opaque paper security cover 41 is attached to the back panel 16 and includes top and bottom edges 42 and 43 respectively and opposite side edges 44 and 45. The dimensions of the security cover 41 are slightly less than those of the core 2 and the panels 15 and 16 so that when the cover 41 is attached to the back panel 16, a peripheral margin 46 of the back panel 16 is left uncovered around the security cover 41. The cover 41 includes first and second portions 47 and 48 integrally connected and demarcated by a tear line 49 extending between the cover side edges 44 and 45 in parallel, spaced relation relative to the cover top and bottom edges 42 and 43. The cover first portion 47, as shown, is adapted to substantially cover the cut-out 9.

An elongated pocket 51 is formed in the cut-out 9 between the front and back panels 15 and 16. The pocket is accessible through a mouth 52 open at the side edges 8 and 20 and terminates at the cut-out blind end 10. The pocket 51 is adapted to be subdivided into a plurality of discrete compartments 53 corresponding to the discrete area subparts 27 lacking the heat sensitive adhesive 25. Each compartment 53 is adapted to receive in completely encased relation a respective microfilm segment 54.

In forming the card 1, the front and back panels 15 and 16 are placed against the front and back surfaces 3 and 4 respectively of the core 2 with the respective top edges 5 and 17, bottom edges 6 and 18 and side edges 7, 8, 19 and 20 aligned. One or more microfilm segments 54 are placed in the cut-out 9 before the front panel 15 is positioned. The microfilm segments 54 are placed on the adhesive-free area subparts 27 beginning with the subpart 27 adjacent the cut-out blind end 10 first and working outward toward the back panel side edge 20. Alternatively, the microfilm segment or segments 54 may be inserted into the pocket 51 through its mouth 52 after the front panel 15 is positioned.

Without limitation on the generality of useful types of information which may be included on the microfilm segments 54, such information may relate to identification of a bearer of the card 1 or to various conditions of the bearer having medical significance. Such medically signifacant conditions might include allergies, medications being taken, known health problems and the like. In particular, the card 1 is designed and adapted to receive microfilm segments 54 containing information relating to the bearer's cardiovascular condition. Such information may take the form of one or more electrocardiograms (ECG's) reproduced on respective microfilm segments 54. Also, a letter from the bearer's regular physician containing diagnoses or specific recommendations may be reproduced on a microfilm segment 54 for inclusion in the pocket 51.

With the microfilm segments 54 positioned on the respective area subparts 27, a spacer 55 is inserted in the pocket 51 between the front and back panels 15 and 16. The spacer 55 has a width slightly less than that of the cut-out 9 and terminates at an end 56. Preferably, the spacer 55 comprises a material with relatively low heat conductivity. The spacer 55 is positioned so that its end 56 is located slightly outwardly (toward the core side edge 8) of the most outward adhesive line 28 whereat the front and back panels 15 and 16 are to be thermally laminated together. For example, if two microfilm segments 54 are to be thermally sealed within respective compartments 53, the spacer end 56 is placed just outwardly of the second adhesive line 28 from the core blind end 10.

The core 2, panels 15 and 16, microfilm segments 54 and spacer 55 are then subjected to heat and pressure in a conventional plastic laminating machine (not shown). The heat sensitive adhesive 25 thereby thermally laminates or bonds the front panel 15 to the core front surface 3, the back panel 16 to the back surface 4 and the front and back panels 15 and 16 together at the adhesive lines 28 not separated by the spacer 55. The microfilm segments 54 within the pocket 51 are thus individually sealed within respective enclosed compartments 53, and are prevented from overlapping or otherwise shifting by the adhesive lines 28 transversely dividing the pocket 51 into the discrete compartments 53. Because the area subparts 27 are free of the heat sensitive adhesive 25, the thermal laminating process will not effect their transparency. Otherwise, the heat sensitive adhesive might tend to form bubbles, cloud or otherwise create distortions in the plastic comprising the panels 15 and 16 which would render the microfilm segments 54 more difficult to view.

Figure 2:
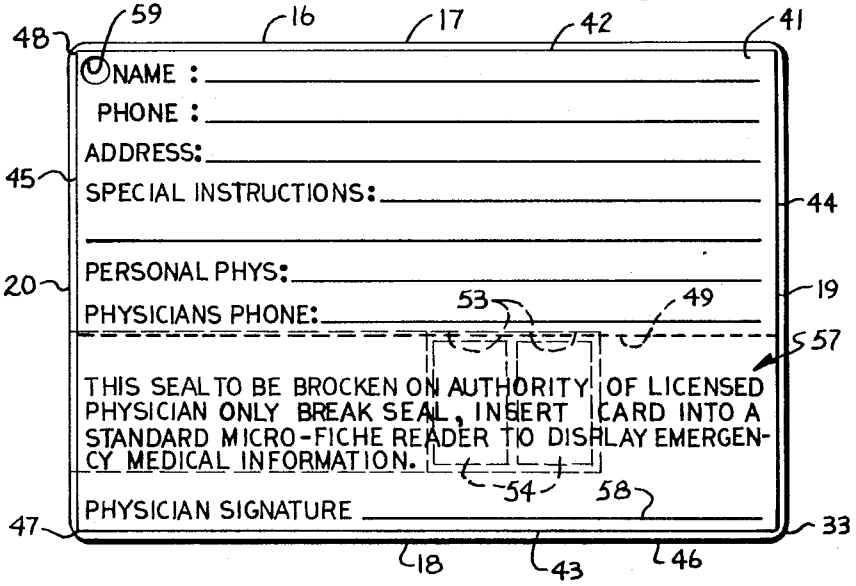
FIG. 2 is a view of the card.
Figure 3:
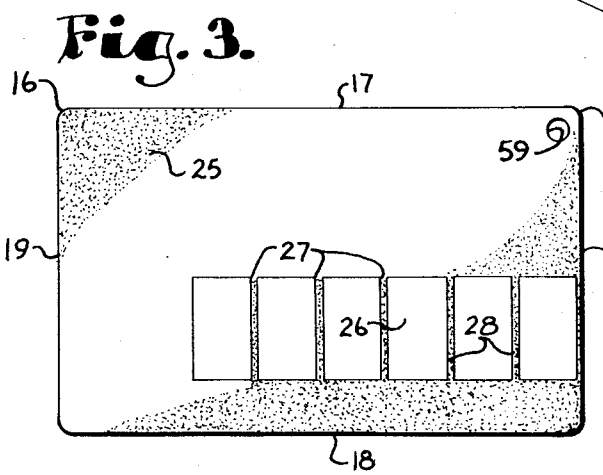
FIG. 3 is a front view of a back panel of the card.
Figure 4:
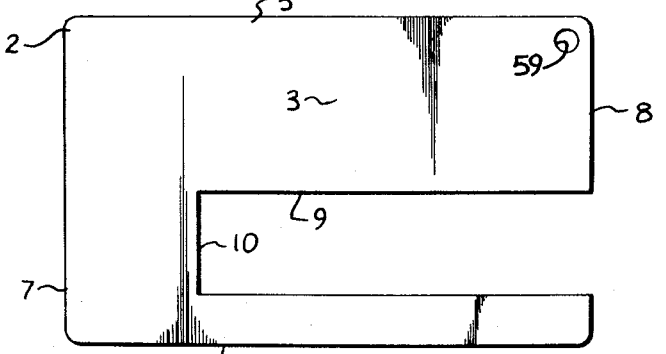
FIG. 4 is a view of a core of the card.
Figure 5:
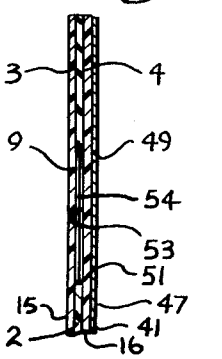
FIG. 5 is an enlarged, fragmentary, vertical cross-sectional view of the card and particularly showing a microfilm segment positioned in a discrete compartment thereof.

The security cover 41 is then prepared for the card 1 and may include on the first portion 47 a notice 57 such as that shown in FIG. 2. Furthermore, a signature line 58 may be provided on the cover first portion 47 for a physician's signature for indicating that on his authority the cover first portion 47 has been removed for access to the emergency medical information on the microfilm segments 54.

Because the cover 41 is opaque, the microfilm segments 54 may not be read without first peeling the cover first portion 47 from the back panel 16. Confidentiality of the information contained on the microfilm segments 54 (e.g. confidential medical records relating to the bearer's cardiovascular problems and conditions) is thus maintained until needed in an actual emergency.

In the event of such an emergency, providing the attending physician with access to a patient's medical records, particularly those relating to cardiovascular conditions and problems, can save valuable time which would otherwise be lost in retrieving this information from the patient's regular physician. Prompt diagnosis and treatment may thus be effected, and the patient's chances for recovery substantially increased.

It is anticipated that heart patient's in particular would find it advantageous to carry the card 1 on their person at all times. Further, persons who have never had a history of heart problems may find it advantageous to have an electrocardiogram prepared, microfilmed and enclosed within the card 1. In this way, if the person suffers a heart attack or experiences some other heart problem, an attending physician could remove the security cover first portion 47 and have access to a normal electrocardiogram for the patient.

By providing a plurality of compartments 53 in the pocket 51, a "history" of electrocardiograms taken sequentially over a period of time may be included in the card 1 on respective microfilm segments 54. A physician attending a patient carrying such a card would have access to a history of the patient's cardiovascular condition as represented by the microfilm electrocardiograms.

Microfilm segments 54 may be added subsequent to the initial forming of the card 1 by inserting them within the pocket 51 into position between remaining subparts 27 of the panels 15 and 16 which have not been sealed into the compartments 53. The spacer 55 is then inserted into any remaining compartments 53, and the card 1 placed in a laminating machine whereby the last-enclosed microfilm segments 54 are sealed within respective compartments 53. Thus a continuous history of the patients' heart condition may be preserved in the card 1, along with any other relevant materials such as a letter from the patient's normal physician as aforesaid.

Although the card 1 is preferably of a size adapted for convenient placement in a wallet or purse, an aperture 59 is provided in one of the corners thereof for receiving a chain (not shown) adapted to encircle the bearer's neck. The card 1 could thus be worn by a person not carrying a wallet or a purse, for example while engaging in an activity such as exercise and the like.

It is to be understood that while certain forms of the present invention have been illustrated and described herein, it is not to be limited to the specific forms or arrangement of parts described and shown.

What is claimed and desired to secure by Letters Patent is as follows:

1. A card which comprises:

(a) a core having:

(1) a front surfae;
(2) a back surface;
(3) a top edge;
(4) a bottom edge;
(5) a pair of opposite side edges; and
(6) an elongated cut-out open at one of said side edges and extending substantially parallel to said core top and bottom edges, said cut-out terminating in a blind end in spaced relation from the other of said core side edges;

(b) transparent front and back panels thermally bonded to said core front and back surfaces respectively, each said panel having:
(1) a heat sensitive adhesive thereon for bonding said panel to said core;
(2) an area covering said cut-out; and
(3) a line of said adhesive extending transversely across said area and dividing said area into a pair of area subparts each free of said adhesive;
(4) said lines of adhesive being bonded together;

(c) an opaque cover attached to said back panel and including:
(1) a first portion covering said cut-out and being removable from said back panel;
(2) a second portion attached to said back panel; and
(3) said first and second portions being integrally connected and demarcated by a tear line, said cover first portion being removable from said cover second portion along said tear line; and (d) a pocket formed by said cut-out between said front and back panels, said pocket being subdivided into a pair of discrete compartments with said adhesive lines bonding said panels together therebetween;

(e) said discrete compartments being adapted to receive at least one microfilm segment visible through said front panel with said cover first portion removed.

2. A card which comprises:
(a) a core having an edge, a cut-out open at said edge and front and back surfaces;
(b) a transparent front panel bonded to said core front surface and covering said cut-out;
(c) a translucent back panel bonded to said core back surface and covering said cut-out;
(d) an opaque cover including:
(1) a first portion covering said cut-out;
(2) a second portion secured to one of said panels; and
(3) said cover first and second portions being demarcted by a tear line whereby said cover first portion is removable from said cover second portion and from said card along said tear line; and
(e) a pocket formed by said cut-out between said front and back panels, said pocket being adapted to receive a microfilm segment visible through said front panel with said cover removed and being accessible at said core edge.

3. A card according to claim 2 which includes:
(a) said cover being adhesively secured to one of said front and back panels.

4. A card which comprises:
(a) a core having a cut-out;
(b) a transparent front panel bonded to said core and covering said cut-out;
(c) a translucent back panel bonded to said core and covering said cut-out; and
(d) an opaque cover, which includes:
(1) a first portion covering said cut-out;
(2) a second portion adhesively secured to one of said panels; and
(3) a tear line demarcating said first and second portions;
(4) said cover first portion being removable from said cover second portion along said tear line;
(e) only said cover second portion being adhesively secured to said one of said panels.

5. The card according to claim 4 wherein:
(a) said core and said front and back panels are thermally laminated together.

6. The card according to claim 4 which includes:
(a) said core having a top and a bottom edge;
(b) said cut-out being elongated and extending substantially parallel to said core top and bottom edges.

7. The card according to claim 4 which includes:
(a) identifying information on said cover.

8. The card according to claim 4 which includes:
(a) a pocket formed by said cutout between said front and back panels; and
(b) divider means adapted for dividing said pocket into a plurality of discrete compartments adapted to receive at least one microfilm segment.

9. The card according to claim 8 which includes:
(a) said divider means comprising a line of adhesive extending transversely across said cut-out and bonding said front and back panels together.

10. The card according to claim 4 which includes:
(a) said panels having adhesive thereon for bonding said panels to said core;
(b) each said panel having an area covering said cut-out;
(c) each said panel having a respective line of adhesive extending transversely across said area;
(d) each said adhesive line dividing a respective area into a pair of discrete subparts free of said adhesive; and
(e) said adhesive lines bonding said panels together whereby corresponding area subparts form a pair of discrete compartments, said compartments being adapted to receive at least one respective microfilm segment.

11. The card according to claim 10 which includes:
(a) said adhesive being heat sensitive.

12. The card according to claim 4 which includes:
(a) said panels having adhesive thereon adapted for bonding said panels to said core;
(b) each said panel having an area in covering relation to said cut-out, at least a subpart of said area being free of said adhesive.

13. The card according to claim 12 which includes:
(a) each said area including a pair of area subparts free of said adhesive; and
(b) a pocket formed by said cutout between said front and back panels; and
(c) said area subparts being separated by a line of said adhesive extending transversely across said area, said adhesive lines being adapted to bond said panels together whereby said pocket is subdivided into plural discrete compartments adapted to receive at least one microfilm segment.

14. The card according to claim 12 which includes:
(a) said adhesive being heat sensitive.

15. A method of forming a card which comprises the steps of:

(a) forming a core with an edge, a cut-out open at said edge and front and back surfaces;

(b) bonding a transparent front panel to said core front surface in covering relation to said cut-out;

(c) bonding a translucent back panel to said core back surface in covering relation to said cut-out;

(d) providing an opaque cover with first and second portions demarcated by a tear line whereby said cover first portion is removable from said cover second portion along said tear line;

(e) adhesively securing only said cover second portion to one of said panels;

(f) covering said cut-out with said cover first portion; and wherein a pocket is defined by said cut-out between said front and back panels, said pocket being adapted to receive a microfilm segement visible through said front panel with said cover removed and accessible at said core edge.

16. The method according to claim 15 which includes the step of:

(a) positioning a spacer in said pocket when said front and back panels are bonded to said core whereby at least a portion of said pocket is maintained open.

17. The method according to claim 15, which includes the additional step of:

(a) inserting a microfilm segment in said pocket.

18. The method according to claim 17 which includes the step of:

(a) enclosing said microfilm segment in a discrete compartment in said pocket.

19. The method according to claim 15 wherein the steps of bonding said panels to said core include the steps of:

(a) applying adhesive to said front and back panels for bonding said panels to said core;

(b) maintaining an area of each said front and back panel free of said adhesive; and (c) placing said front and back panels against said core with said adhesive-free areas positioned in covering relation to said cut-out.

20. The method according to claim 19 wherein the adhesive applying step further includes applying a line of adhesive across the area of one of said front and back panels whereby said area is subdivided into a pair of area subparts; and which further includes the steps of:

(g) positioning said microfilm segment at one of said area subparts; and (h) bonding said front and back panels together at said adhesive line whereby said pocket is subdivided into a pair of discrete compartments, one of said compartments enclosing said microfilm segment.

21. The method according to claim 19 wherein the adhesive applying step further includes applying a plurality of adhesive lines to one said panel whereby said area is divided into a plurality of subparts; and which further includes the steps of;

(g) inserting discrete microfilm segments in said pocket;

(h) positioning each said microfilm segment at a respective said area subpart;

(i) joining said panels together at a respective adhesive line adjacent each said microfilm segment whereby said microfilm segment is enclosed in a discrete compartment;

(j) positioning a spacer in said pocket at the remaining adhesive lines when said panels are joined together to maintain said panels separate thereat; and (k) repeating steps (g) through (j) at a later time.

* * * * *